US009639041B2

(12) United States Patent
Awano

(10) Patent No.: US 9,639,041 B2
(45) Date of Patent: May 2, 2017

(54) FIXING DEVICE AND IMAGE FORMING APPARATUS

(71) Applicant: FUJI XEROX CO., LTD., Tokyo (JP)

(72) Inventor: Jumpei Awano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/042,816

(22) Filed: Feb. 12, 2016

(65) Prior Publication Data

US 2017/0052489 A1 Feb. 23, 2017

(30) Foreign Application Priority Data

Aug. 19, 2015 (JP) ..... 2015-162243

(51) Int. Cl.
*G03G 15/20* (2006.01)

(52) U.S. Cl.
CPC ..... *G03G 15/2053* (2013.01)

(58) Field of Classification Search
CPC ..... G03G 2215/2038
See application file for complete search history.

(56) References Cited

U.S. PATENT DOCUMENTS 8,583,020 B2 11/2013 Yoshikawa et al.
2008/0219724 A1* 9/2008 Lee ..... G03G 15/2053 399/329
2011/0229225 A1* 9/2011 Ishii ..... G03G 15/2039 399/329

FOREIGN PATENT DOCUMENTS

JP 2011-197182 A 10/2011
JP 2014149446 A * 8/2014

* cited by examiner

*Primary Examiner* — Clayton E Laballe
*Assistant Examiner* — Victor Verbitsky
(74) *Attorney, Agent, or Firm* — Oliff PLC

(57) ABSTRACT

A fixing device includes a belt member that rotates to fix a toner image to a recording material; a pressing unit that, along with the belt member, presses the recording material while the pressing unit rotates; a heating section that contacts an inner side of the belt member and heats the belt member; and a nip forming portion that is provided at the inner side of the belt member, and that forms a nip where the recording material is nipped between the belt member and the pressing unit. In the fixing device, the heating section is disposed at an outer side of a locus of the belt member where the heating section is not provided and that is nipped by the nip forming portion and the pressing unit.

5 Claims, 5 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2015-162243 filed Aug. 19, 2015.

BACKGROUND

Technical Field

The present invention relates to a fixing device and an image forming apparatus.

SUMMARY

According to an aspect of the invention, there is provided a fixing device including a belt member that rotates to fix a toner image to a recording material; a pressing unit that, along with the belt member, presses the recording material while the pressing unit rotates; a heating section that contacts an inner side of the belt member and heats the belt member; and a nip forming portion that is provided at the inner side of the belt member, and that forms a nip where the recording material is nipped between the belt member and the pressing unit. In the fixing device, the heating section is disposed at an outer side of a locus of the belt member where the heating section is not provided and that is nipped by the nip forming portion and the pressing unit.

BRIEF DESCRIPTION OF THE DRAWINGS

An exemplary embodiment of the present invention will be described in detail based on the following figures, wherein.

DETAILED DESCRIPTION

An exemplary embodiment is hereunder described in detailed with reference to the attached drawings.

Figure 1:
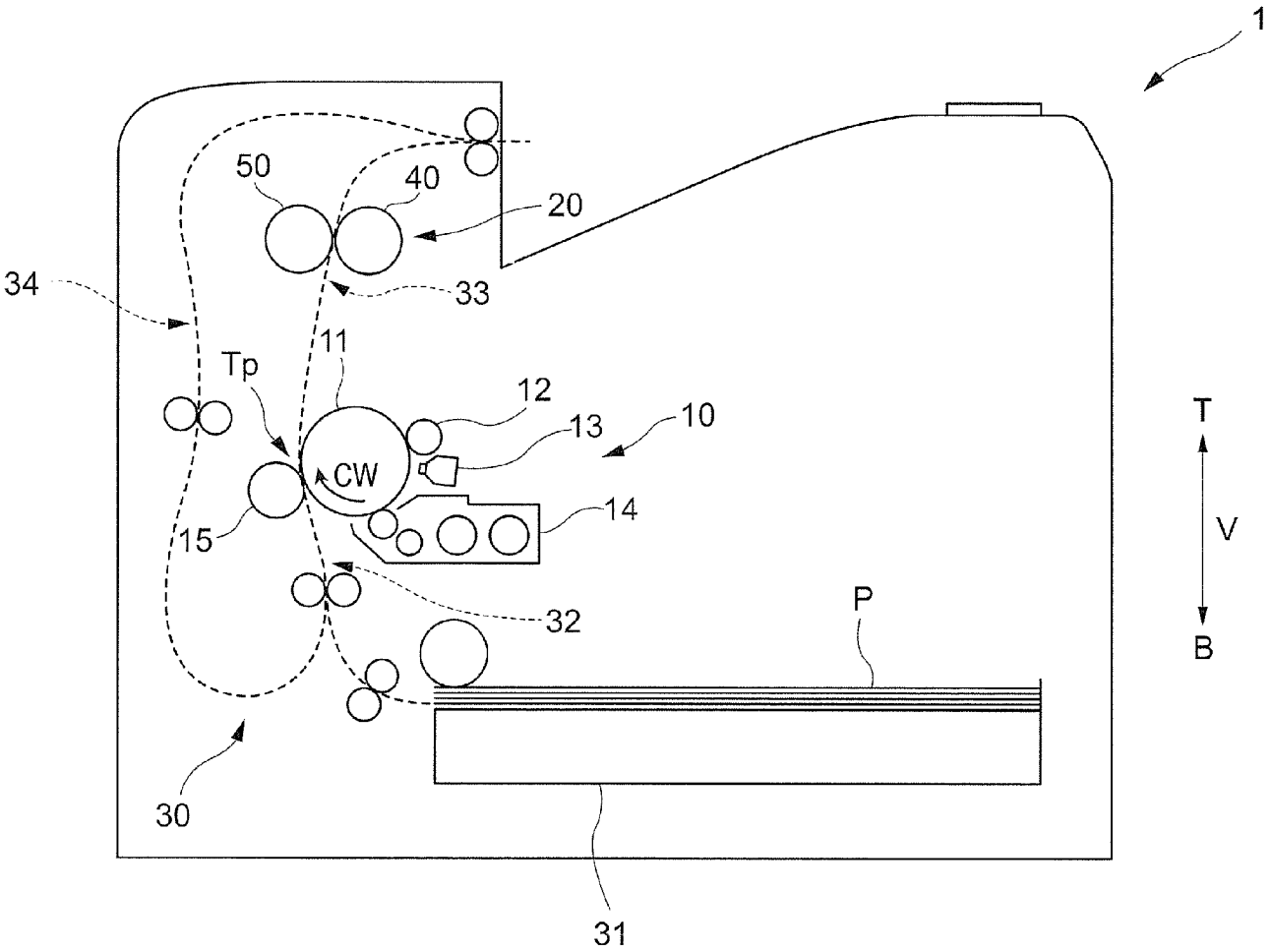
FIG. 1 illustrates the structure of an image forming apparatus according to an exemplary embodiment.

FIG. 1 illustrates the structure of an image forming apparatus 1 according to the exemplary embodiment.

The image forming apparatus 1 includes an image forming device 10 that forms a toner image on a sheet P (an example of a recording material), a fixing device 20 that fixes the toner image formed on the sheet P by the image forming device 10, and a sheet transport system 30 that supplies a sheet P to the image forming device 10.

In the description below, an up-down direction in the plane of the image forming apparatus 1 shown in FIG. 1 is an up-down direction V. In the up-down direction, an upper side in the plane of the image forming apparatus 1 shown in FIG. 1 is an upper side T, and a lower side in the plane of the image forming apparatus 1 shown in FIG. 1 is a lower side B.

The image forming device 10 includes a photoconductor drum 11, a charging device 12 that charges the photoconductor drum 11, an exposure device 13 that exposes the photoconductor drum 11 to light, a developing device 14 that performs development on the charged photoconductor drum 11, and a transfer device 15 that transfers the toner image formed on the photoconductor drum 11 to a sheet P.

Although, in the exemplary embodiment, the image forming apparatus 1 including one photoconductor drum 11 is exemplified, the image forming apparatus 1 may be a so-called tandem type including multiple photoconductor drums 11.

The photoconductor drum 11 includes a photosensitive layer at its outer peripheral surface, and rotates in the direction of arrow CW in FIG. 1. The charging device 12 includes a charging roller that contacts the photoconductor drum 11, and charges the photoconductor drum 11 to a predetermined potential. The exposure device 13 irradiates the photoconductor drum 11 with laser light to selectively expose the photoconductor drum 11 charged by the charging device 12 to the light, and forms an electrostatic latent image on the photoconductor drum 11.

The developing device 14 contains, for example, a two-component developer that contains toner and carriers, the toner being charged to a negative polarity and the carriers being charged to a positive polarity. The developing device 14 develops the electrostatic latent image formed on the photoconductor drum 11 with toner, and forms a toner image on the photoconductor drum 11.

The transfer device 15 includes a roller member, and transfers the toner image on the photoconductor drum 11 to a sheet P by forming an electrical field between the transfer device 15 and the photoconductor drum 11 (transfer portion Tp).

The fixing device 20 includes a fixing belt unit 40 and a pressing roller unit 50. By causing the sheet P to which the toner image has been transferred to pass between the fixing belt unit 40 and the pressing roller unit 50, the fixing device 20 fixes the toner image to the sheet P by a fixing operation using heat and pressure.

The fixing device 20 is described in more detail below.

The sheet transport system 30 includes a sheet accommodating unit 31 that accommodates sheets P, a first transport path section 32 that forms a transport path of the sheets P from the sheet accommodating unit 31 to the transfer portion Tp, a second transport path section 33 that forms a transport path for the sheets P from the transfer portion Tp to the fixing device 20 and to a sheet stacking section where the sheets P are stacked, and a reverse transport path section 34 that forms a path for reversing the front and back of the sheet P that has passed through the fixing device 20 and resupplying the reversed sheet P to the transfer portion Tp.

Next, the fixing device 20 according to the exemplary embodiment is described.

Figure 2:
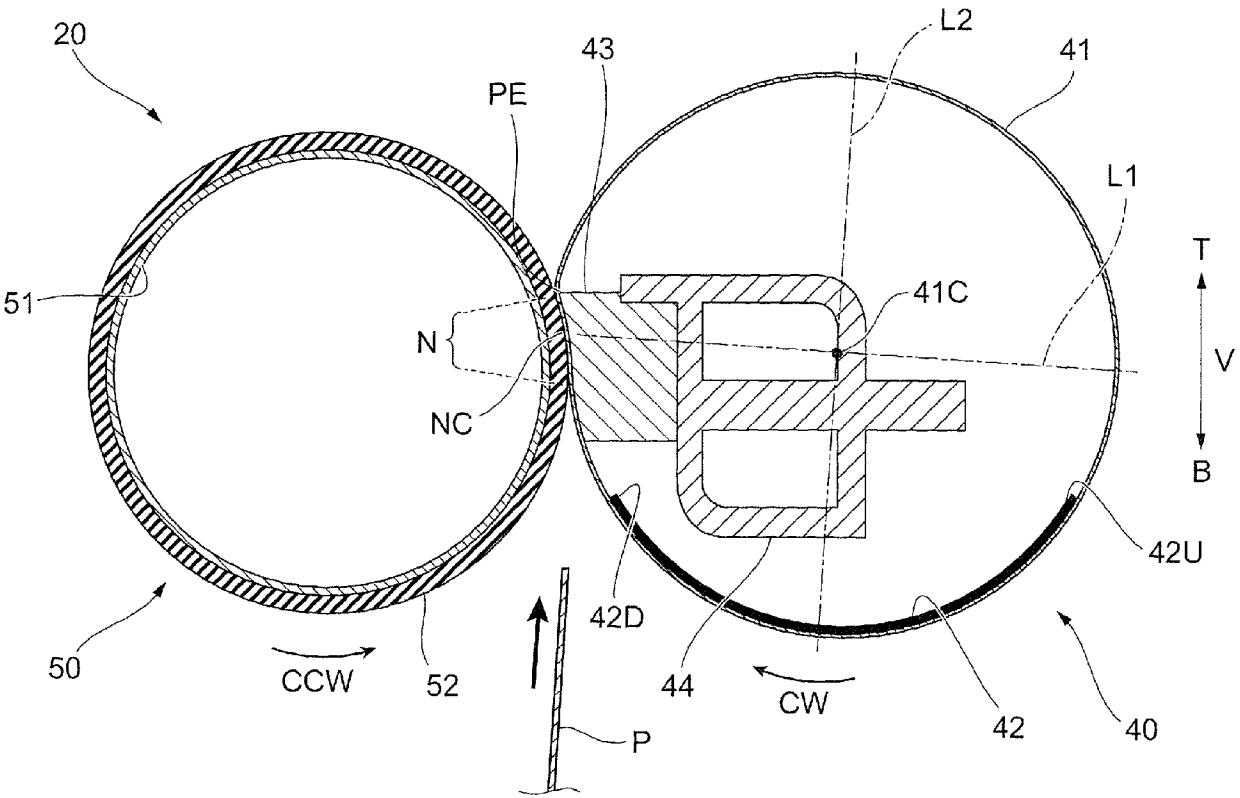
FIG. 2 is an explanatory view of a fixing device according to the exemplary embodiment.

FIG. 2 is an explanatory view of the fixing device 20 according to the exemplary embodiment.

As shown in FIG. 2, the fixing device 20 according to the exemplary embodiment includes the fixing belt unit 40 and the pressing roller unit 50. The pressing roller unit 50 is an example of a pressing unit and is provided so as to oppose the fixing belt unit 40.

The fixing belt unit 40 and the pressing roller unit 50 extend so as to be long in a direction that crosses the transport direction of the sheets P. FIG. 2 shows a cross section of the fixing belt unit 40 and a cross section of the pressing roller unit 50 that cross an axial direction of the fixing belt unit 40 and an axial direction of the pressing roller unit 50, respectively.

Structure/Function of Fixing Belt Unit 40

The fixing belt unit 40 includes a fixing belt 41 that is an example of a belt member, a heating member 42 that is an example of a heating section and that is provided at an inner side of the fixing belt 41, a pressing pad 43 that is an example of a nip forming portion and that is provided at the inner side of the fixing belt 41, and a supporting member 44 that is provided at the inner side of the fixing belt 41.

In the fixing belt unit 40 according to the exemplary embodiment, elastic force of the fixing belt 41 itself is used to contact the fixing belt 41 with the heating member 42 without using external force. In addition, contactability between the fixing belt 41 and the heating member 42 is increased while reducing a rotation driving load of the fixing belt 41. The structure for realizing what is described above is described in detail below.

The fixing belt 41 is an annular (endless) belt. As shown in FIG. 2, the cross section of the fixing belt 41 is circular. The fixing belt 41 rotates in the direction of arrow CW in FIG. 2, and circulates around a rotation center 41C of the fixing belt 41.

Oil is applied to an inner peripheral surface of the fixing belt 41 according to the exemplary embodiment. Sliding resistance between the fixing belt 41 and the members that contact the inner peripheral surface of the fixing belt 41 is reduced.

The fixing belt 41 is flexible and is capable of being elastically deformed. The fixing belt 41 according to the exemplary embodiment has a rigidity that allows it to maintain its cross section in a circular shape even by, for example, its own weight. For example, the fixing belt 41 includes a base layer that is made of polyimide resin, an elastic layer that is stacked on a surface (outer peripheral surface) of the base layer and that is made of silicone rubber, and a release layer that covers the elastic layer and that is made of tetrafluoroethylene-perfluoroalkylvinylether copolymer resin (PFA).

In the description below, with a nip N (described below) being a reference point, an upstream side in the rotation direction of the fixing belt 41 may be simply called an upstream side, and a downstream side in the rotation direction of the fixing belt 41 may be simply called a downstream side.

Further, in the description below, the fixing belt 41 is described by roughly dividing the fixing belt 41 into four regions. That is, a line that passes through the rotation center 41C and a nip center NC (described below) is defined as a first reference line L1. A line that passes through the rotation center 41C and is orthogonal to the first reference line L1 is defined as a second reference line L2.

The heating member 42 is formed as a flat heat source. The heating member 42 may be, for example, a member including a base material, such as SUS, provided with glass by firing, and having a wiring pattern. In the heating member 42 according to the exemplary embodiment, by passing electric current through the wiring pattern, Joule heat is generated. The heating member 42 is provided so as to contact the fixing belt 41, and generates heat to heat the fixing belt 41.

In the fixing device 20 according to the exemplary embodiment, the heating member 42 is formed separately from the nip N (pressing pad 43), and contacts and heats the fixing belt 41 from an internal portion of the fixing belt 41. By this, in the fixing device 20 according to the exemplary embodiment, since the heating member 42 does not form the nip N (pressing pad 43), it is possible to reduce the strength of the heating member 42. In addition, since it is possible to reduce the strength of the heating member 42, the heat capacity of the heating member 42 becomes small, so that a warmup time, which is the time taken to reach a fixing temperature, is reduced.

The heating member 42 is provided so as to extend along an axial direction of a circular cylinder of the fixing belt 41. The cross section of the heating member 42 has an arc shape. The arc-shaped heating member 42 is formed along a circular belt locus 410 of the belt in a free state (described below). In the exemplary embodiment, a central angle of the arc of the heating member 42 is set at, for example, approximately 120 degrees.

The heating member 42 is disposed at a region that is situated at the upstream side with respect to the first reference line L1. An upstream-side end portion 42U of the heating member 42 is provided at a region that is opposite to the nip N with respect to the second reference line L2. For example, at the side opposite to the nip N with respect to the second reference line L2, the upstream-side end portion 42U according to the exemplary embodiment is provided in a range of angles that are greater than or equal to approximately 0 degrees to less than or equal to approximately 45 degrees with reference to the first reference line L1 in the rotation direction of the fixing belt 41 (direction of arrow CW in FIG. 2).

A downstream-side end portion 42D of the heating member 42 is provided at a region that is at the side of the nip N with respect to the second reference line L2. For example, the downstream-side end portion 42D according to the exemplary embodiment is provided in a range of angles that are greater than or equal to approximately 0 degrees to less than or equal to approximately 45 degrees with reference to the first reference line L1 at the side of the nip N with respect to the second reference line L2 and in a direction opposite to the rotation direction of the fixing belt 41 (opposite to the direction of arrow CW in FIG. 2). However, in this range, the downstream-side end portion 42D is provided at a region where it does not contact an end portion of the pressing pad 43.

As shown in FIG. 2, the fixing belt 41 is moved by the pressing roller 50, and rotates in the direction of arrow CW in FIG. 2. Therefore, at the region that is situated at the upstream side with respect to the first reference line L1 (region at the lower side B in FIG. 2), the tension of the fixing belt 41 according to the exemplary embodiment becomes relatively high as a result of the fixing belt 41 being drawn into the nip N. In particular, the tension of a portion of the fixing belt 41 that is closer to the nip N is higher than that of a portion of the fixing belt 41 that is farther from the nip N. In contrast, at a region that is situated at the downstream side with respect to the first reference line L1 (region at the upper side T in FIG. 2), the tension of the fixing belt 41 according to the exemplary embodiment becomes relatively low as a result of the fixing belt 41 being pushed out from the nip N. Therefore, in the exemplary embodiment, by disposing the heating member 42 at the upstream side, the shape of the fixing belt 41 at the upstream side moving towards the nip N is stabilized. In particular, by positioning the downstream-side end portion 42D of the heating member 42 close to the nip N, the angle of entry of the fixing belt 41 into the nip N does not become a sharp angle.

The pressing pad 43 forms the nip N, which is a portion where the pressing roller unit 50 and the fixing belt 41 contact each other. At a portion of the pressing pad 43 where the nip N is formed, an arc-shaped recessed portion is formed along an external shape of the pressing roller unit 50. As shown in FIG. 2, a central portion of the nip N (middle of the arc shape) along a peripheral direction of the fixing belt 41 is defined as the nip center NC.

Examples of a base material of the pressing pad 43 include metals such as iron and SUS and resin having heat resistance. The surface of the pressing pad 43 may be made of an elastic material such as silicone rubber or fluororubber.

At a downstream-side end portion of the pressing pad 43 (hereunder referred to as "pad end portion PE"), the pressing pad 43 forms a curved portion in the fixing belt 41. The pad end portion PE of the pressing pad 43 changes the curvature of the fixing belt 41, and allows a sheet P to be easily separated from the fixing belt 41.

The supporting member 44 is secured to a frame (not shown) at an end portion in an axial direction of the fixing belt 41. The supporting member 44 supports the pressing pad 43.

In the fixing belt unit 40 according to the exemplary embodiment, only the heating member 42 and the pressing pad 43 contact the fixing belt 41. Therefore, in the fixing device 20 according to the exemplary embodiment, the position and the shape of the fixing belt 41 that is nipped by the pressing roller unit 50 and the pressing pad 43 are determined by the heating member 42.

Structure/Function of Pressing Roller Unit 50

The pressing roller unit 50 includes a cylindrical portion 51 and an elastic layer 52 that is formed around an outer side of the cylindrical portion 51 in a radial direction.

The cylindrical portion 51 is made of, for example, a metallic material.

The material of the elastic layer 52 may be, for example, silicone rubber. The surface of the elastic layer 52 may be made of, for example, fluororesin.

The pressing roller unit 50 is pushed against the fixing belt unit 40 by a predetermined pressing force. The pressing roller unit 50 is rotated in the direction of arrow CCW shown in FIG. 2 by a motor (not shown). The pressing roller unit 50 rotates the fixing belt unit 40.

In the fixing device 20 according to the exemplary embodiment having the above-described structure, a sheet is supplied to the nip N that is formed between the fixing belt unit 40 and the pressing roller unit 50. At the nip N, the sheet P is pressed by the fixing belt unit 40 and the pressing roller unit 50. This causes toner images on the sheet P to be pressed and heated, and to be fixed to the sheet P.

Next, the relationship between the disposition of the heating member 42 and the fixing belt 41 is described.

Figure 3:
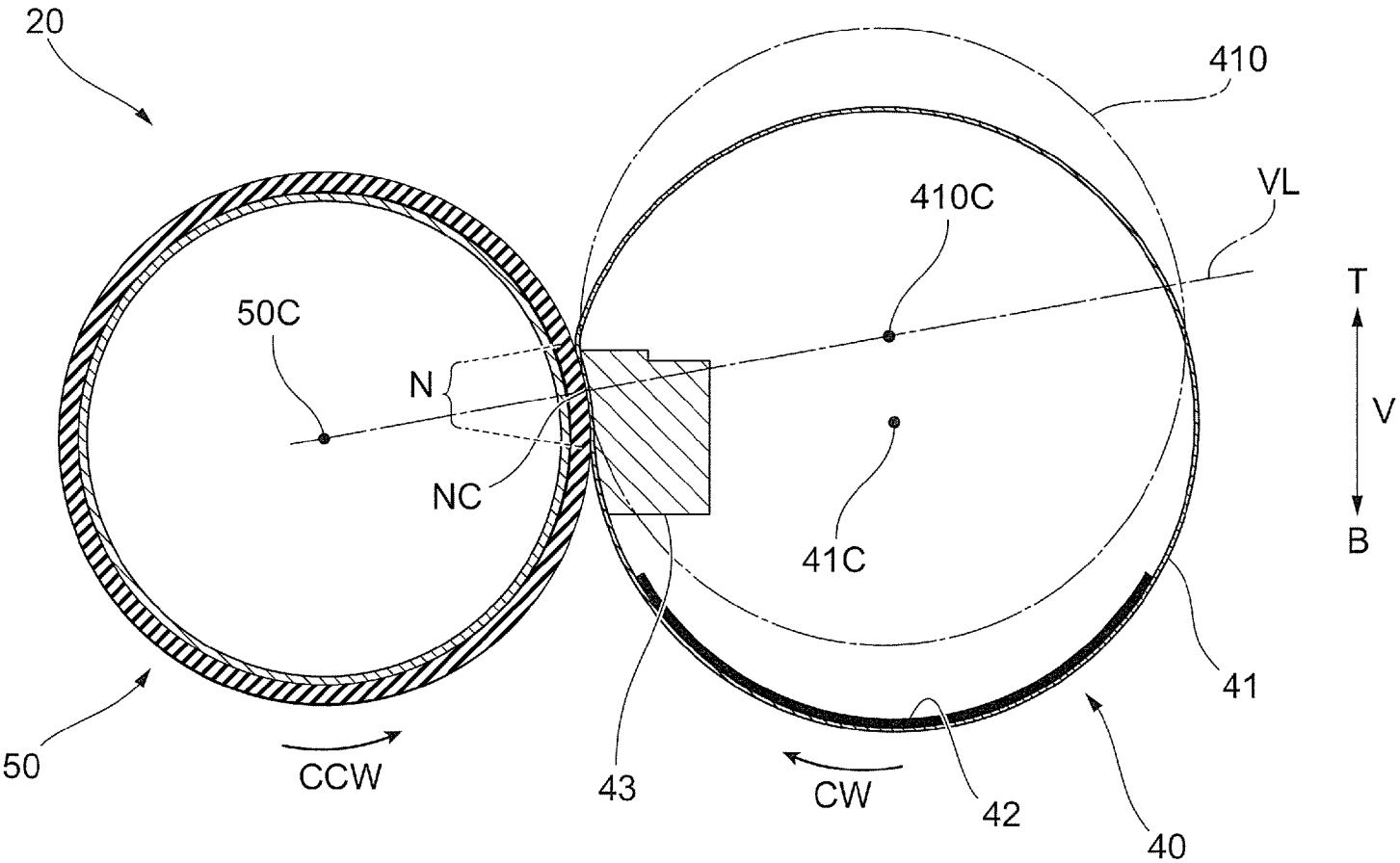
FIG. 3 is an explanatory view of the disposition of a heating member according to the exemplary embodiment.

FIG. 3 is an explanatory view of the disposition of the heating member 42 according to the exemplary embodiment.

In the description below, the supporting member 44 is not illustrated.

First, in the fixing device 20, a circular locus of the fixing belt 41 on which the heating member 42 is not mounted and that is nipped by the pressing pad 43 and the pressing roller unit 50 is defined as the belt locus 410 of the belt in a free state. The cross section of the fixing belt 41 according to the exemplary embodiment is circular. Therefore, the belt locus 410 of the belt in a free state is a belt locus in which a line that passes through the nip center NC of the nip N becomes a chord.

In the exemplary embodiment, the heating member 42 is disposed at an outer side of the belt locus 410 of the belt in a free state in a radial direction of the belt locus 410 of the belt in a free state. That is, the heating member 42 is positioned at the outer side of the fixing belt locus in which the line that passes through the nip center NC of the nip N is a chord.

As shown in FIG. 3, a rotation center 410C of the belt locus 410 of the belt in a free state is positioned on an imaginary line VL that passes through a rotation center 50C of the pressing roller unit 50 and the nip N (nip center NC). The heating member 42 according to the exemplary embodiment is provided such that the rotation center 41C of the fixing belt 41 is displaced from the imaginary line VL that passes through the rotation center 50C of the pressing roller unit 50 and the nip N (nip center NC).

By disposing the heating member 42 according to the exemplary embodiment at the outer side of the belt locus 410 of the belt in a free state, the fixing belt 41 is deformed towards the lower side B in the exemplary embodiment. As a result, the fixing belt 41 is pushed against the heating member 42 by a force that causes the fixing belt 41 to return to the belt locus 410 of the belt in a free state by elastic force of the fixing belt 41.

As described above, in the fixing device 20 according to the exemplary embodiment, instead of, for example, by pushing the heating member 42 against the fixing belt 41 by using outside force of a spring or the like, the fixing belt 41 contacts the heating member 42 by the elastic force of the fixing belt 41 itself. Therefore, in the fixing device 20 according to the exemplary embodiment, contactability between the fixing belt 41 and the heating member 42 is increased while reducing a rotational driving load of the fixing belt 41. Further, in the fixing device 20 according to the exemplary embodiment, compared to when a different member, such as a spring, contacts the heating member 42, the heat of the heating member 42 is less likely to be taken away by the different member. Therefore, heating efficiency is increased.

In addition, in the fixing device 20 according to the exemplary embodiment, the tension of the fixing belt 41 generated by rotationally driving the fixing belt 41 removes a warp that may occur in the heating member 42, so that the fixing belt 41 and the heating member 42 stably contact each other.

First Modification

Figure 4:
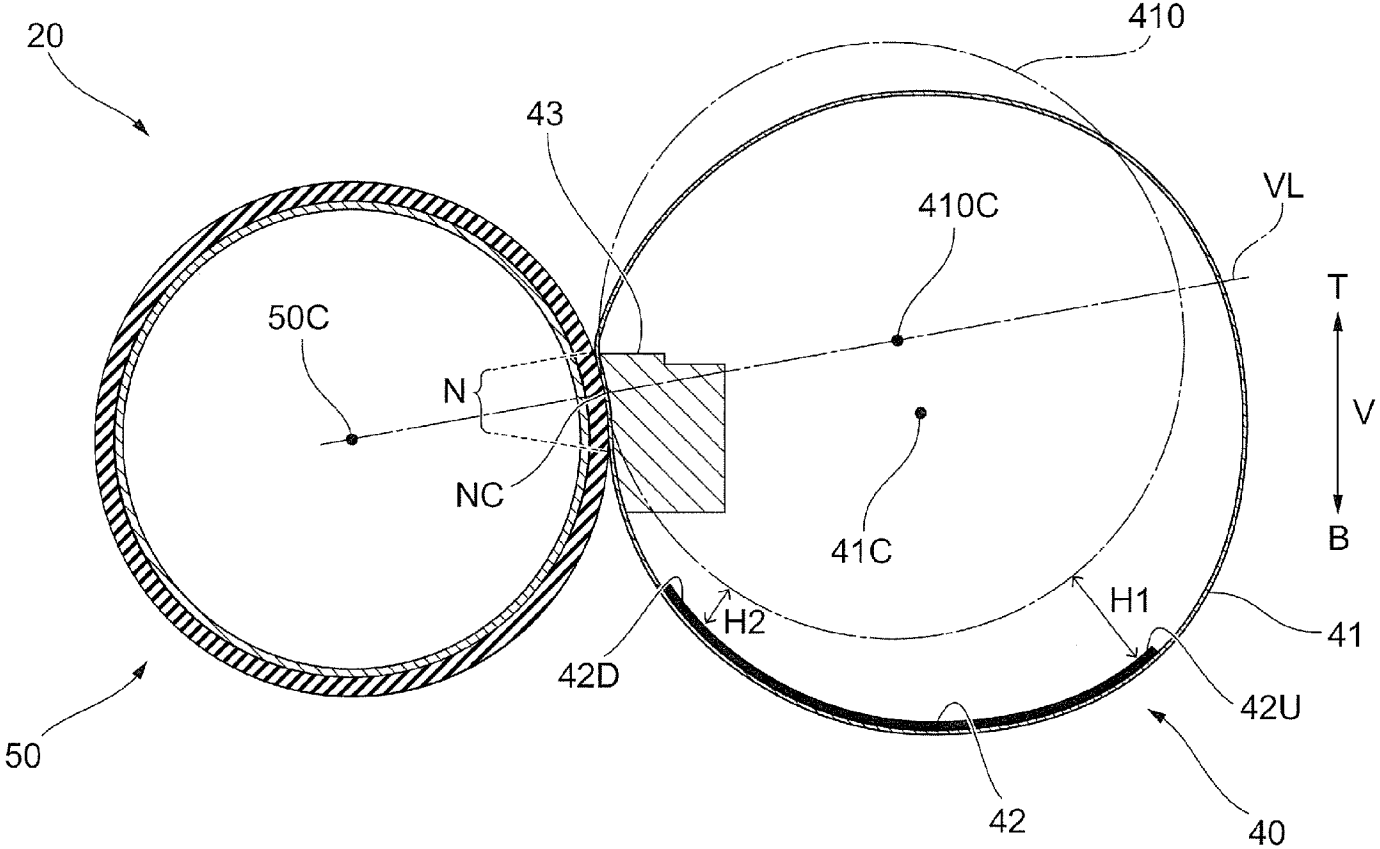
FIG. 4 is an explanatory view of a heating member according to a first modification.

FIG. 4 is an explanatory view of a heating member 42 according to a first modification.

The heating member 42 according to the first modification differs from the heating member 42 according to the above-described exemplary embodiment in the cross-sectional shape of the heating member 42.

Regarding the distance between the heating member 42 according to the first modification and the belt locus 410 of the belt in a free state (that is, a length in a radial direction in which the rotation center 410C of the belt locus 410 of the belt in a free state is the center), an upstream-side end portion 42U (uppermost stream portion) of the heating member 42 is farthest from the belt locus 410 of the belt in a free state than the other portions of the heating member 42 are. More specifically, as shown in FIG. 4, a distance H1 between the upstream-side end portion 42U of the heating member 42 and the belt locus 410 of the belt in a free state is greater than a distance H2 between a downstream-side end portion 42D and the belt locus 410 of the belt in a free state.

In addition, in the exemplary embodiment, in the rotation direction of the fixing belt 41, the distance between the heating member 42 and the belt locus 410 of the belt in a free state is gradually decreased from the upstream-side end portion 42U towards the downstream-side end portion 42D.

In the fixing device 20 according to the first modification having such a structure, contact force generated by elastic force of the fixing belt 41 is larger at the upstream-side end portion 42U than at the downstream-side end portion 42D of the heating member 42. In addition, in the first modification, by firmly holding the fixing belt 41 at the upstream-side end portion 42U where the fixing belt 41 and the heating member 42 start to contact each other, so-called flapping of the fixing belt 41 with respect to the heating member 42 is reduced to stabilize the movement of the fixing belt 41. By maximizing the contact force generated by the fixing belt 41 at the upstream-side end portion 42U, straightening ability of the fixing belt 41 for straightening the heating member 42 is improved.

Second Modification

Figure 5:
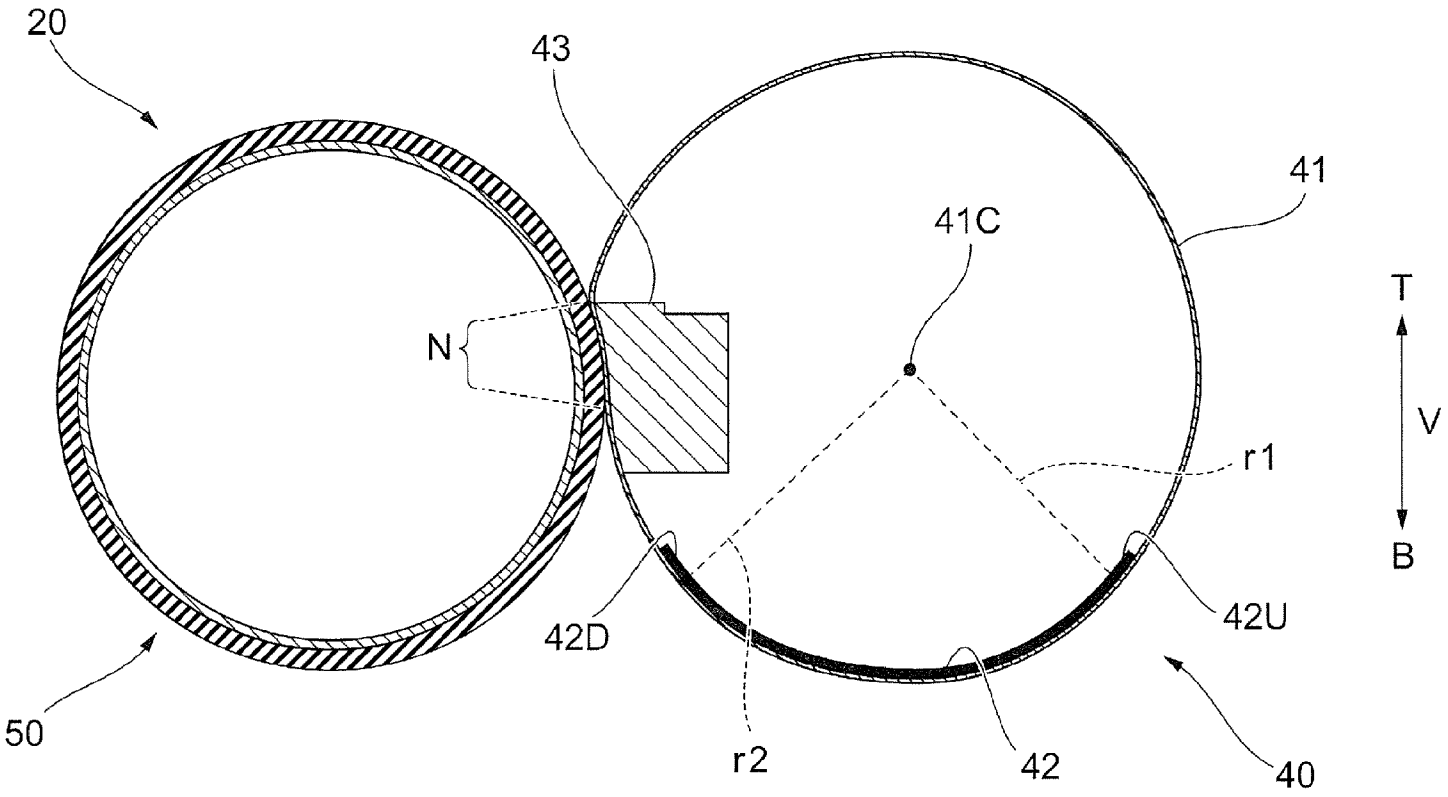
FIG. 5 is an explanatory view of a heating member according to a second modification.

FIG. 5 is an explanatory view of a heating member 42 according to a second modification.

The heating member 42 according to the second modification differs from the heating member 42 according to the above-described exemplary embodiment in the cross-sectional shape of the heating member 42.

The curvature of the heating member 42 according to the second modification is larger at the upstream side in the rotation direction of the fixing belt 41 than at the downstream side in the rotation direction of the fixing belt 41. More specifically, as shown in FIG. 5, a radius r1 at an upstream-side end portion 42U of the heating member 42 is smaller than a radius r2 at a downstream-side end portion 42D of the heating member 42. That is, the curvature (1/r1) at the upstream-side end portion 42U of the heating member 42 is larger than the curvature (1/r2) at the downstream-side end portion 42D of the heating member 42.

When the curvature is increased by, for example, a certain tension, the pressure is increased. Therefore, in a fixing device 20 according to the second modification having the above-described structure, contact force of the fixing belt 41 is larger at the upstream-side end portion 42U of the heating member 42 than at the downstream-side end portion 42D of the heating member 42. In addition, in the second modification, by firmly holding the fixing belt 41 at the upstream-side end portion 42U where the fixing belt 41 and the heating member 42 start to contact each other, the movement of the fixing belt 41 is stabilized.

Further, as described above, in addition to the structure according to the first modification, the structure according to the second modification is applicable. That is, the distance H1 between the upstream-side end portion 42U of the heating member 42 and the belt locus 410 of the belt in a free state is larger than the distance H2 between the downstream-side end portion 42D and the belt locus 410 of the belt in a free state, and the curvature (1/r1) at the upstream-side end portion 42U of the heating member 42 is larger than the curvature (1/r2) at the downstream-side end portion 42D of the heating member 42.

Here, if it is assumed that the curvature of the heating member 42 does not change in a peripheral direction, the tension of the fixing belt 41 at the downstream-side end portion 42D, which is a side that is close to the nip N, tends to be increased. Therefore, contactability between the fixing belt 41 and the heating member 42 is capable of being improved by causing the contact force between the fixing belt 41 and the heating member 42 to be uniform along the peripheral direction of the heating member 42 as a result of adding the structure according to the second modification to the structure according to the first modification.

In the fixing device 20 according to the exemplary embodiment, as described with reference to FIG. 3, the heating member 42 is provided such that the entire heating member 42 is disposed at the outer side of the belt locus 410 of the belt in a free state in a radial direction. However, at least part of the heating member 42 may be provided at the outer side of the belt locus 410 of the belt in a free state in a radial direction. Even in this case, the fixing belt 41 contacts the heating member 42 by restoring force of the fixing belt 41 based on elastic force of the fixing belt 41.

In the fixing device 20 according to the exemplary embodiment, as described with reference to FIG. 2, the heating member 42 is provided at the upstream side with respect to the first reference line L1. However, the position of the heating member 42 is not limited to the upstream side with respect to the first reference line L1. The heating member 42 may be provided at any other region as long as the region is situated at the outer side of the belt locus 410 of the belt in a free state in a radial direction. Even in this case, the fixing belt 41 contacts the heating member 42 by restoring force of the fixing belt 41 based on elastic force of the fixing belt 41.

In the exemplary embodiment, a member in the form of a roller is used as the pressing roller unit 50. However, instead of the pressing roller unit 50, for example, a pressing unit having the form of a belt and pressing, along with the fixing belt 41, a sheet P may be used.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a belt member that rotates to fix a toner image to a recording material;

a pressing unit that, along with the belt member, presses the recording material while the pressing unit rotates;

a heating section that contacts an inner side of the belt member and heats the belt member; and a nip forming portion that is provided at the inner side of the belt member, the nip forming portion forming a nip where the recording material is nipped between the belt member and the pressing unit, wherein the heating section is disposed at an outer side of a locus of the belt member when the heating section is not provided and that is nipped by the nip forming portion and the pressing unit, and wherein the heating section is positioned such that a rotation center of the belt member is displaced from an imaginary line that passes through a rotation center of the pressing unit and a center of the nip, and wherein a distance of the heating section from the locus is larger at an upstream side of the heating section in a rotation direction of the belt member than at a downstream side of the heating section in the rotation direction of the belt member, and wherein the distance of the heating section from the locus is gradually decreased from the upstream side to the downstream side.

2. The fixing device according to claim 1, wherein the heating section is provided at a region that is situated at an upstream side in a rotation direction of the belt member with respect to an imaginary line that passes through the nip and a rotation center of the belt member.

3. The fixing device according to claim 2, wherein the heating section includes an upstream-side end portion in the rotation direction of the belt member, and the upstream-side end portion of the heating section is provided opposite to the nip with the rotation center being interposed therebetween.

4. The fixing device according to claim 1, wherein a curvature of the heating section is larger at an upstream side of the heating section in a rotation direction of the belt member than at a downstream side of the heating section in the rotation direction of the belt member.

5. An image forming apparatus comprising:

an image holding body that holds a toner image;

a transfer unit that transfers the toner image to a recording material;

a belt member that rotates to fix the toner image to the recording material;

a pressing unit that, along with the belt member, presses the recording material while the pressing unit rotates;

a nip forming portion that is provided at an inner side of the belt member, the nip forming portion forming a nip where the recording material is nipped between the belt member and the pressing unit; and a heating section that contacts the inner side of the belt member and heats the belt member, the heating section being disposed at an outer side of a locus of the belt member when the heating section is not provided, and the heating section being positioned such that a rotation center of the belt member is displaced from an imaginary line that passes through a rotation center of the pressing unit and a center of the nip, wherein a distance of the heating section from the locus is larger at an upstream side of the heating section in a rotation direction of the belt member than at a downstream side of the heating section in the rotation direction of the belt member, and wherein the distance of the heating section from the locus is gradually decreased from the upstream side to the downstream side.

* * * * *